US006792126B2

(12) United States Patent
Okuno et al.

(10) Patent No.: US 6,792,126 B2
(45) Date of Patent: Sep. 14, 2004

(54) INFORMATION PROCESSING DEVICE AND SPEAKER UNIT APPLICABLE THERETO

(75) Inventors: Hideyuki Okuno, Kawasaki (JP); Wataru Tanaka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/151,026

(22) Filed: Sep. 10, 1998

(65) Prior Publication Data

US 2002/0018574 A1 Feb. 14, 2002

(30) Foreign Application Priority Data

May 15, 1998 (JP) ..... 10-133116

(51) Int. Cl.[7] ..... H04R 25/00

(52) U.S. Cl. ..... 381/412; 381/423; 381/431; 381/395; 381/388; 381/333; 381/386; 340/388.1; 340/388.4; 361/682; 361/354

(58) Field of Search ..... 381/306, 384, 381/388, 333, 396, 152, 151, 412, 431, 423; 340/388.1, 388.3, 388.4, 391.1

(56) References Cited

U.S. PATENT DOCUMENTS 3,727,719 A * 4/1973 Yando
3,728,497 A * 4/1973 Komutsu
4,392,027 A * 7/1983 Bock
4,514,599 A * 4/1985 Yanagishima
4,550,428 A * 10/1985 Yanagishima
4,641,345 A * 2/1987 Takahashi
5,125,031 A * 6/1992 Ledonne
5,583,945 A * 12/1996 Iijima et al. ..... 381/199
5,847,922 A * 12/1998 Smith et al. ..... 361/685
5,930,376 A * 7/1999 Markow
6,332,029 B1 * 12/2001 Azima et al.

FOREIGN PATENT DOCUMENTS

JP 3-191391 8/1991

* cited by examiner

*Primary Examiner*—Huyen Le
*Assistant Examiner*—Dionne Harvey
(74) *Attorney, Agent, or Firm*—Armstrong, Kratz, Quintos, Hanson & Brooks, LLP

(57) ABSTRACT

An information processing device and a speaker unit applicable to the device. In one aspect of the present invention, the device includes a housing, a pole piece, a voice coil, a magnet, and a frame. The housing has an elastically vibratory vibration region. The pole piece has a first end and a second end. The first end is fixed to the vibration region of the housing. The voice coil is fixed to the second end of the pole piece. The magnet forms a magnetic field interlinking the voice coil. The frame fixes the magnet to the housing at a region other than the vibration region, for example. With this configuration, vibration of the voice coil due to a current flowing through the voice coil is transmitted through the pole piece to the vibration region of the housing, thus eliminating the need for a vibration board of a speaker and further eliminating the need for formation of holes for sound transmission through the housing.

12 Claims, 5 Drawing Sheets

INFORMATION PROCESSING DEVICE AND SPEAKER UNIT APPLICABLE THERETO

BACKGROUND OF THE INVENTION

1. Field of the Invention

The present invention relates to an information processing device having a speaker for reproducing sound information and also to a speaker unit applicable to the device.

2. Description of the Related Art

FIG. 1 is a perspective view showing a conventional information processing device by way of example. This device includes a first housing 4 having a keyboard unit 2 and a second housing 8 having a display unit 6. The second housing 8 can be opened and closed with respect to the first housing 4 through a hinge mechanism not shown. A speaker 10 is built in the second housing 8. A sound wave generated from the speaker 10 is radiated out of the housing 8 through a plurality of holes 12 formed through the housing 8.

FIG. 2 is a sectional view of the speaker 10 and its associated parts of the device shown in FIG. 1. The speaker 10 includes a frame 13 fixed to an inner surface of the housing 8, a magnetic circuit 14 fixed to the frame 13, a voice coil 16 provided so as to interlink a magnetic field generated by the magnetic circuit 14, and a vibration board 18 vibrated in accordance with movement of the voice coil 16.

When an electrical signal for reproducing sound information is passed through the voice coil 16, the voice coil 16 is moved back and forth in a lateral direction as viewed in FIG. 2 in the magnetic field given by the magnetic circuit 14. The vibration of the voice coil 16 is converted into a sound wave (compression wave in the atmospheric air) by the vibration board 18. The sound wave thus generated is radiated out of the housing 8 through the holes 12 of the housing 8.

In the conventional device shown in FIGS. 1 and 2, the holes 12 must be formed through the housing 8 to reproduce sound information, so that this device is not suitable for use in an adverse environment as in a dusty environment. Further, the speaker 10 and other electronic components built in the housing 8 are susceptable to moisture or the like in the use environment of the device.

It may be proposed to build the speaker 10 in the housing 8 without forming the holes 12 through the housing 8. In this case, however, sound cannot be reproduced or otherwise sound quality is degraded.

SUMMARY OF THE INVENTION

It is therefore an object of the present invention to provide an information processing device which can reproduce sound information with high sound quality without the need for formation of the holes for sound transmission through the housing.

It is another object of the present invention to provide a speaker unit applicable to the device.

In accordance with an aspect of the present invention, there is provided an information processing device having a first configuration. The first configuration comprises a housing, a pole piece, a voice coil, a magnet, and a frame. The housing has an elastically vibratory vibration region. The pole piece has a first end and a second end. The first end is fixed to the vibration region of the housing. The voice coil is fixed to the second end of the pole piece. The magnet forms a magnetic field interlinking the voice coil. The frame fixes the magnet to the housing at a region other than the vibration region, for example.

In accordance with another aspect of the present invention, there is provided an information processing device having a second configuration. The second configuration comprises a housing, a magnet, a voice coil, and a frame. The housing has an elastically vibratory vibration region. The magnet is fixed directly or indirectly to the vibration region of the housing. The voice coil is provided so as to interlink a magnetic field formed by the magnet. The frame fixes the voice coil to the housing at a region other than the vibration region, for example.

According to the first or second configuration, the vibration region of the housing can be directly vibrated without the use of the vibration board of the speaker in the conventional device. Accordingly, it is possible to provide an information processing device which can reproduce sound information with high sound quality without the need of formation of the holes for sound transmission through the housing. In the first configuration, vibration of the voice coil due to a current flowing through the voice coil is transmitted through the pole piece to the vibration region of the housing. In the second configuration, vibration of the magnet due to a current flowing through the voice coil is transmitted to the vibration region of the housing.

Preferably, the vibration region of the housing has a thickness smaller than that of a region of the housing other than the vibration region. With this configuration, it is possible to ensure compatibility between improvement in mechanical strength of the whole or most of the housing and improvement in frequency response characteristics in sound information reproduction. Further, since the vibration region is thin, the energy for vibration of the vibration region can be suppressed to thereby reduce a drive current to be supplied to the voice coil.

Preferably, the housing has an airtight structure. With this configuration, the device can be used even in an adverse environment as in a dusty environment in addition to the advantage that the holes for sound transmission need not be formed through the housing.

Preferably, the housing comprises a first housing having a keyboard unit and a second housing having a display unit, the second housing being openable and closable with respect to the first housing, and the vibration region is defined in the vicinity of the display unit of the second housing. In the case that the outer surface of the vibration region of the housing is plane or concave, directivity possibly occurs in sound information reproduction in the vibration region. In this respect, by defining the vibration region in the vicinity of the display unit of the second housing, sound information can be well transmitted to a user viewing the display unit, and the transmission of sound information to others is suppressed. Thus, it is possible to provide an information processing device suitable for personal use.

Preferably, the housing is formed of resin. In the case of forming the housing by injection molding of resin, for example, it is easy to make the vibration region of the housing thinner than the other region of the housing.

In accordance with a further aspect of the present invention, there is provided a speaker unit having a first configuration. The first configuration of the speaker unit comprises a pole piece, a voice coil, a magnet, a frame, and a damper. The pole piece has a first end and a second end. The first end is adapted to be fixed to a vibration region of a housing. The voice coil is fixed to the second end of the pole piece. The magnet forms a magnetic field interlinking the voice coil. The frame fixes the magnet to the housing at a region other than the vibration region, for example. The damper displaceably supports the pole piece to the frame.

In accordance with a still further aspect of the present invention, there is provided a speaker unit having a second configuration. The second configuration of the speaker unit comprises a magnet, a voice coil, a frame, and a damper. The magnet is adapted to be fixed to a vibration region of a housing. The voice coil is provided so as to interlink a magnetic field formed by the magnet. The frame fixes the voice coil to the housing at a region other than the vibration region, for example. The damper displaceably supports the magnet to the frame.

According to the first or second configuration of the speaker unit, it is possible to easily provide the first or second configuration of the information processing device according to the present invention, respectively.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Some preferred embodiments of the present invention will now be described in detail with reference to the attached drawings.

Figure 3:
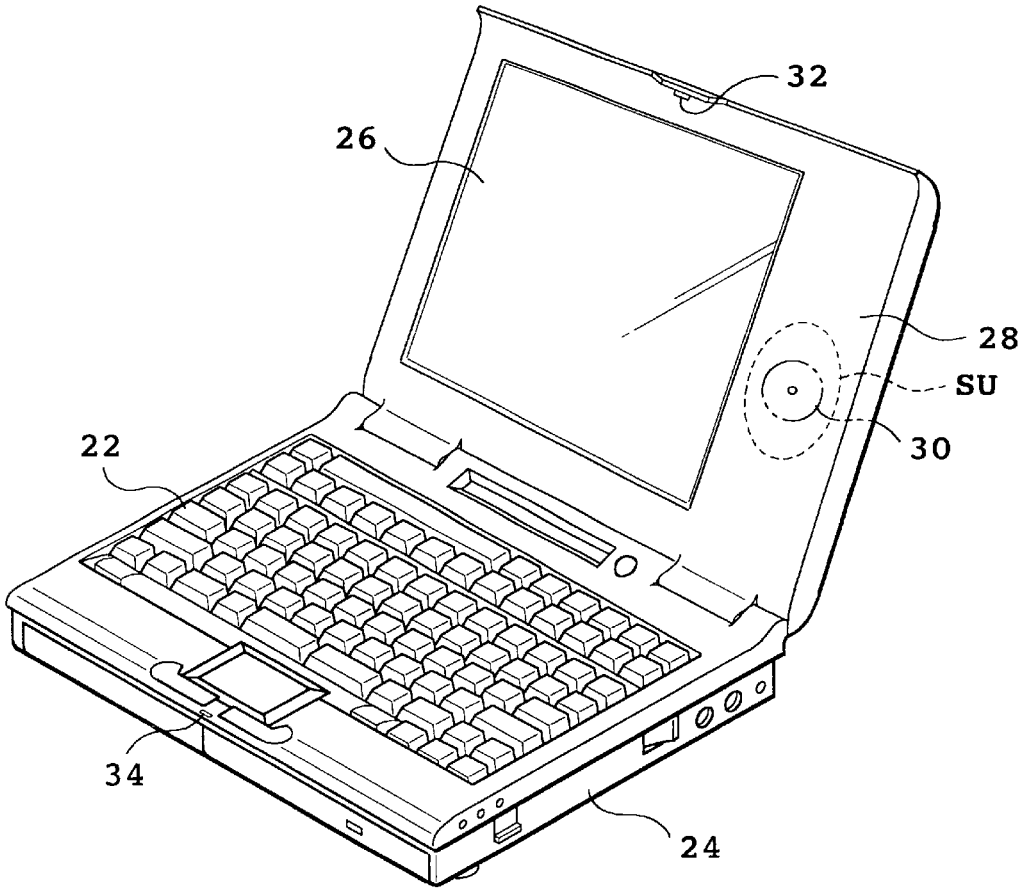
FIG. 3 is a perspective view showing a preferred embodiment of the information processing device according to the present invention.

FIG. 3 is a perspective view showing a preferred embodiment of the information processing device according to the present invention. Possible examples of this device are laptop, notebook, and other portable information processing devices (personal computers, word processors, etc.). This device includes a first housing 24 having a keyboard unit 22 and a second housing 28 having a display unit 26 such as a liquid crystal display (LCD). The second housing 28 can be opened and closed with respect to the first housing 24 through a hinge mechanism (not shown.) Each of the housings 24 and 28 is formed by injection molding of resin, for example.

An elastically vibratory vibration region 30 is defined in the vicinity of the display unit 26 of the second housing 28. The vibration region 30 is vibrated by a speaker unit SU provided inside the housing 28, thereby reproducing sound information.

The open condition of the second housing 28 with respect to the first housing 24 as shown in FIG. 3 is suitable for inputting or the like by use of the keyboard unit 22 as viewing the display unit 26, whereas the closed condition of the second housing 28 with respect to the first housing 24 is suitable for carriage of the information processing device. By engaging a hook member 32 provided on the second housing 28 into a hole 34 formed through the first housing 24 in the closed condition of the second housing 28 with respect to the first housing 24, this closed condition is maintained. In this closed condition, the keyboard unit 22 and the display unit 26 are opposed to each other and confined between the housings 24 and 28, thereby allowing protection of the keyboard unit 22 and the display unit 24.

Figure 4:
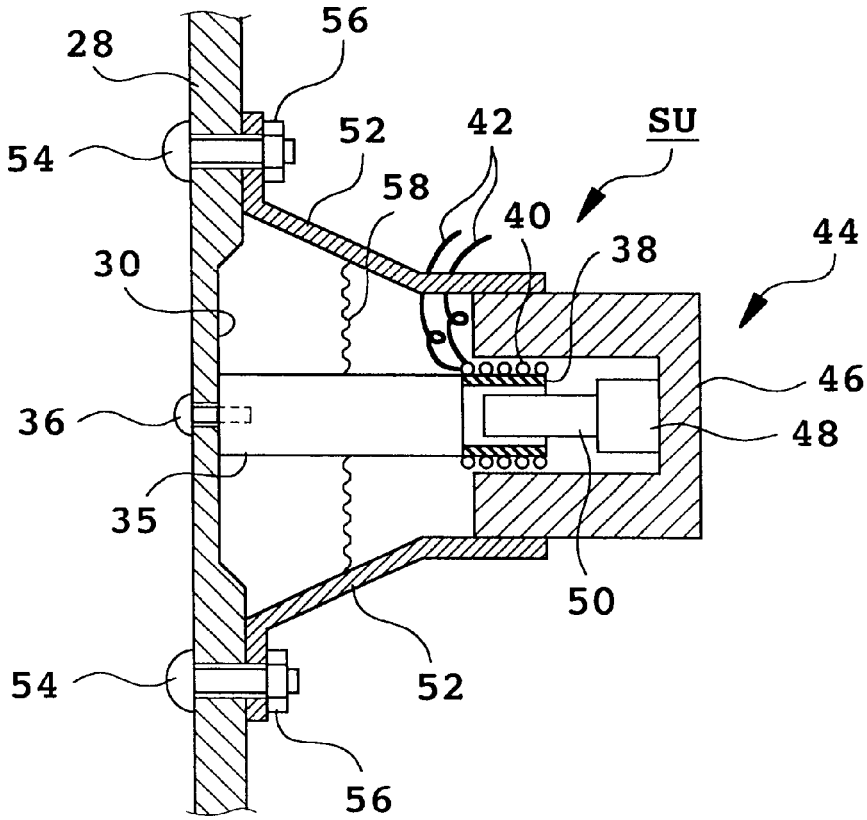
FIG. 4 is a sectional view of a speaker unit applied to the device shown in FIG. 3.

FIG. 4 is a sectional view of a preferred embodiment of the speaker unit SU and its associated parts of the device shown in FIG. 3. In this preferred embodiment, the speaker unit SU is of a coil moving type. A solid or hollow cylindrical pole piece 35 is fixed at its one end (first end) to a substantially central portion of the vibration region 30 of the housing 28 by a bolt 36. A thin-walled hollow cylindrical bobbin 38 is fixed to the other end (second end) of the pole piece 35, and a voice coil 40 is wound around the bobbin 38. Two leads 42 are connected at their first ends to the voice coil 40, so as to pass a drive current to the voice coil 40. The second ends of the two leads 42 are connected to a sound circuit not shown.

A magnetic circuit 44 is used to form a magnetic field interlinking the voice coil 40. The magnetic circuit 44 is composed of a cylindrical first member 46 having a closed end, a magnet 48 fixed to an inner surface of the first member 46, and a cylindrical second member 50 fixed to the magnet 48. The first and second members 46 and 50 are formed of a ferromagnetic material. With this configuration of the magnetic circuit 44, a magnetic field is formed between the first member 46 and the second member 50 so as to interlink the voice coil 40. The magnet 48 is fixed to the housing 28 at its region other than the vibration region 30 by a frame 52. More specifically, the first member 46 of the magnetic circuit 44 is fixed to one end of the frame 52, and the other end of the frame 52 is fixed to a region of the housing 28 other than the vibration region 30 by means of bolts 54 and nuts 56.

When a current is passed through the coil 40 interlinking the magnetic field, the coil 40 is moved back and forth in a lateral direction as viewed in FIG. 4 by a force having a magnitude and direction determined by the magnitude and direction of the current. Thus, the coil 40 is vibrated according to this force. The vibration of the coil 40 is transmitted through the pole piece 35 to the vibration region 30 of the housing 28. Accordingly, the vibration region 30 is vibrated according to an output signal from the sound circuit. The vibration of the vibration region 30 generates a compression wave in the air near the vibration region 30, thereby reproducing sound information.

Figure 1:
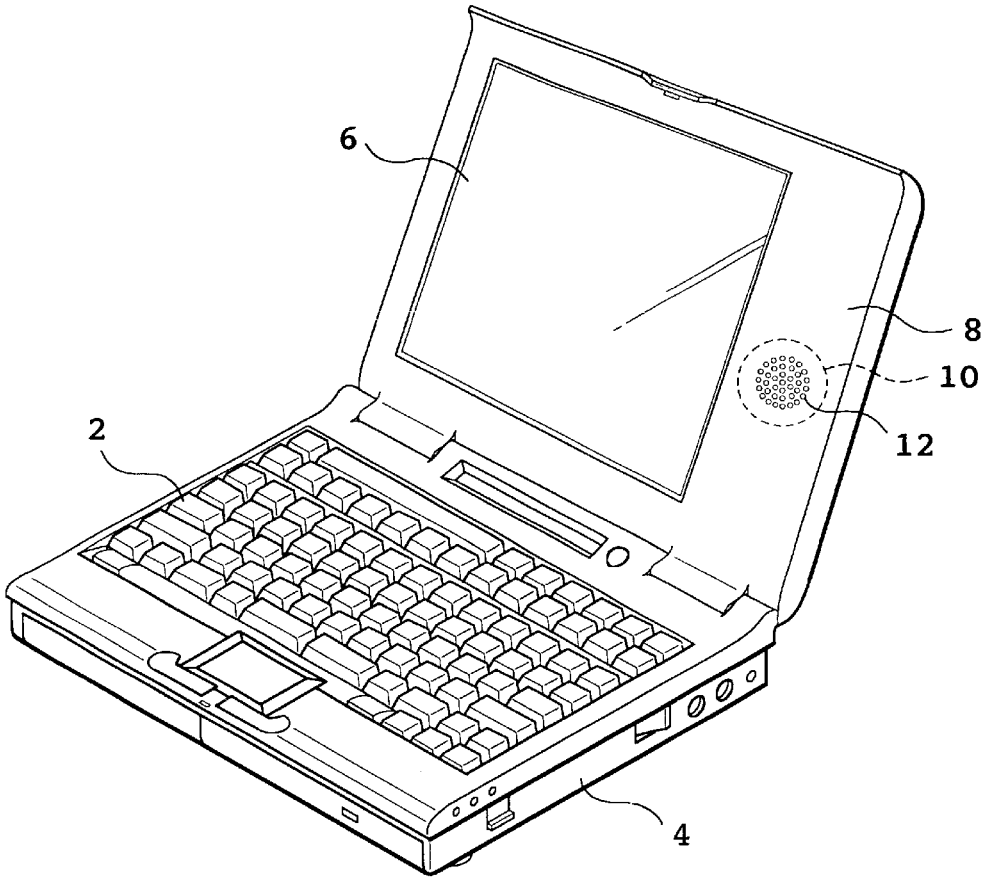
FIG.1 PRIOR ART
FIG. 1 is a perspective view showing a conventional information device by way of example.
Figure 2:
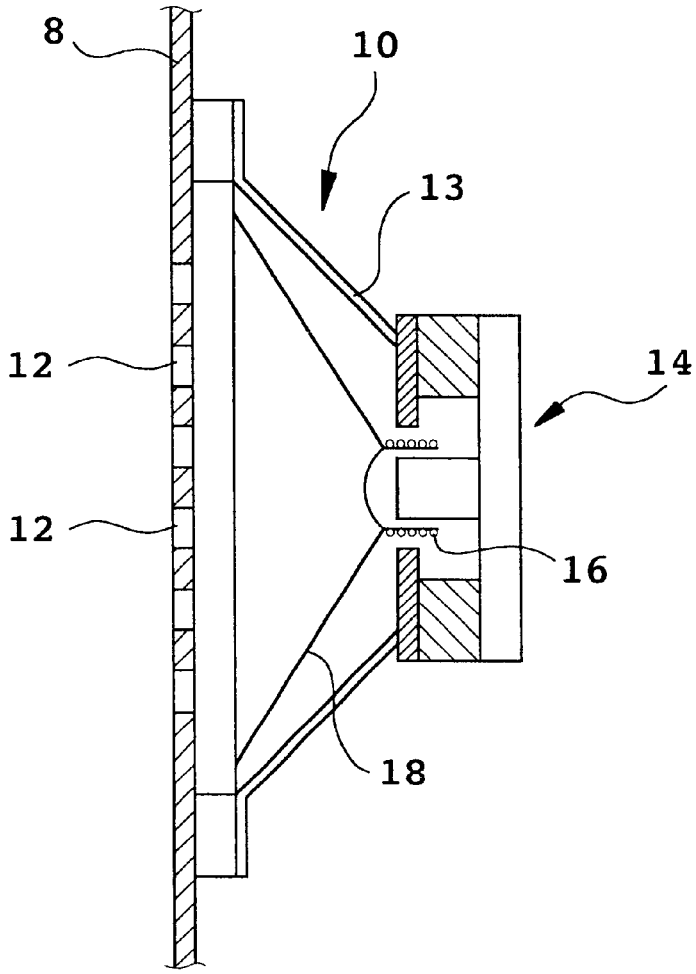
FIG.2 PRIOR ART
FIG. 2 is a sectional view of the device shown in FIG. 1.

According to this preferred embodiment, the vibration region 30 of the housing 28 is directly driven by the speaker unit SU, so that a conventional vibration board (see the vibration board 18 shown in FIG. 2) is not required, thereby simplifying the device configuration. Furthermore, it is unnecessary to form holes for sound transmission through the housing 28, thereby allowing use of the device even in an adverse environment as in a dusty environment. Additionally, since the holes for sound transmission through the housing 28 is not required, the housing 28 can be formed to have an airtight structure, thereby improving the reliability of components contained in the housing 28. Although the housing 28 has holes for receiving the bolts 36 and 54, these holes can be airtightly sealed by the heads of the bolts 36 and 54 or by a caulking material (not shown.)

Particularly in this preferred embodiment, the vibration region 30 of the housing 28 has a thickness smaller than that of the other region of the housing 28. Accordingly, it is possible to increase a degree of freedom of design of form parameters such as the thickness of the vibration region 30 for allowing resonance of the vibration region 30 in an auditory band as ensuring the mechanical strength of the housing 28.

The pole piece 35 and the frame 52 may be directly fixed to the housing 28 by an adhesive or the like.

With the configuration of the above preferred embodiment, it is possible to provide an information processing device which can reproduce sound information with high sound quality without the need for formation of the holes for sound transmission through the housing. However, in the case of providing the speaker unit SU for the information processing device as a separate component, there is a possibility that the speaker unit SU may become uneasy to store, carry, etc. because the pole piece 35, the bobbin 38, and the voice coil 40 are not integrated or assembled with the other components of the speaker unit SU. To cope with this problem, this preferred embodiment further includes a damper 58 for displaceably supporting the pole piece 35 to the frame 52. The damper 58 is in the form of disk having a center hole for allowing insertion of the pole piece 35, and it is formed from an elastically deformable film, for example.

By use of the damper 58, the speaker unit SU can be easily provided as a separate component. Furthermore, in the condition where the speaker unit SU is mounted on the housing 28, undesirable vertical displacement of the voice coil 40 as viewed in FIG. 4 can be prevented to thereby ensure a good operation of the speaker unit SU.

Figure 5:
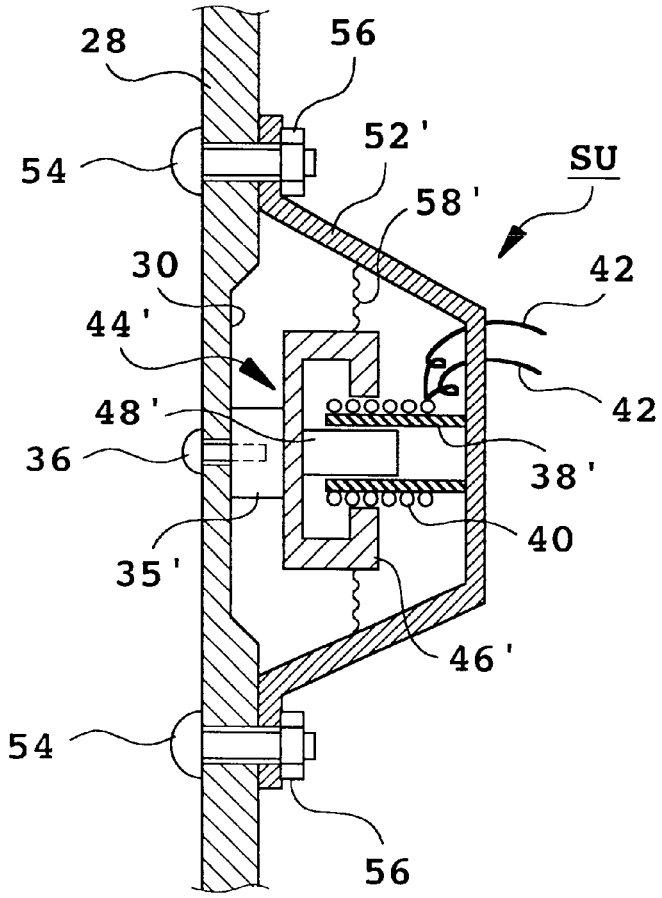
FIG. 5 is a sectional view of another speaker unit applicable to the device shown in FIG. 3.

FIG. 5 is a sectional view of another preferred embodiment of the speaker unit SU and its associated parts of the device shown in FIG. 3. In this preferred embodiment, the speaker unit SU is of a magnet moving type. That is, a magnetic circuit 44' is fixed through a pole piece 35' to the vibration region 30 of the housing 28, and a bobbin 38' around which the voice coil 40 is wound is fixed to a frame 52'. The magnetic circuit 44' is composed of a member 46' fixed to the pole piece 35' and a magnet 481 for forming a magnetic field interlinking the coil 40 in cooperation with the member 46'. The member 46' is formed of a ferromagnetic material. In this manner, the preferred embodiment shown in FIG. 5 is characterized in that the arrangement of the coil 40 and the magnetic circuit 44' is reverse to the arrangement of the coil 40 and the magnetic circuit 44 in the preferred embodiment shown in FIG. 4.

In the preferred embodiment shown in FIG. 5, when a sound current is passed through the coil 40, the magnetic circuit 44' is vibrated in a horizontal direction as viewed in FIG. 5, and the vibration of the magnetic circuit 44' is transmitted through the pole piece 35' to the vibration region 30 of the housing 28. Thus, the vibration of the vibration region 30 causes reproduction of sound information.

Like the previous preferred embodiment shown in FIG. 4, also according to this preferred embodiment shown in FIG. 5, it is possible to provide an information processing device which can reproduce sound information with high sound quality without the need for formation of the holes for sound transmission through the housing.

Further, also in this preferred embodiment shown in FIG. 5, a damper 58' for displaceably supporting the magnet 48' to the frame 52' is provided to thereby facilitate storage, carriage, etc. of the speaker unit SU provided as a separate component. The damper 58' is connected to the outer circumference of the member 46', so as to displaceably support the magnet 48' to the frame 52'.

The magnet 48' or the magnetic circuit 44' may be directly fixed to the vibration region 30 of the housing 28 without the pole piece 35'.

While the outer surface of the vibration region 30 of the housing 28, i.e., the surface of the vibration region 30 opposite to the surface to which the pole piece 35 or 35' is fixed is a plane surface in each of the above preferred embodiments, the outer surface of the vibration region 30 may be made concave. With this configuration, it is possible to provide an information processing device suitable for personal use according to the principles mentioned above.

While the frame is provided to fix the magnet or the voice coil to the housing at its region other than the vibration region in the above preferred embodiments, the frame may be provided to fix the magnet or the voice coil to the housing at the vibration region.

However, the former configuration that the frame is provided to fix the magnet or the voice coil to the housing at its region other than the vibration region is preferable because the vibration region can be efficiently driven.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. An information processing device comprising:

a housing of said information processing device, said housing having an airtight structure and integrally including an elastically vibratory vibration region made of the same material as said housing, said vibration region being thin enough for generating a vibration and having no open holes formed therein which would allow air to pass through;

a pole piece having a first end and a second end, said first end being fixed to said vibration region;

a voice coil fixed to said second end of said pole piece;

a magnet forming a magnetic field interlinking said voice coil; and a frame fixing said magnet to said housing at a region other than said vibration region.

2. An information processing device according to claim 1, wherein said vibration region of said housing has a thickness smaller than that of a region of said housing other than said vibration region.

3. An information processing device according to claim 1, wherein said housing comprises a first housing having a keyboard unit and a second housing having a display unit, said second housing being openable and closable with respect to said first housing;

said vibration region being defined in the vicinity of said display unit of said second housing.

4. An information processing device according to claim 1, wherein said housing is formed of resin.

5. An information processing device according to claim 1, further comprising a damper for displaceably supporting said pole piece to said frame.

6. A speaker unit for an information processing device comprising:

a pole piece having a first end and a second end, said first end being adapted to be fixed to a vibration region of a housing of said information processing device, said vibration region being integrally included in said housing and made of the same material as the rest of the housing, and being thin enough for generating a vibration and having no open holes formed therein which would allow air to pass through;

a voice coil fixed to said second end of said pole piece;

a magnet forming a magnetic field interlinking said voice coil;

a frame fixing said magnet to said housing at a region other than said vibration region; and a damper displaceably supporting said pole piece to said frame.

7. An information processing device comprising:

a housing of said information processing device, said housing having an airtight structure and integrally including an elastically vibratory vibration region made of the same material as said housing, said vibration region being thin enough for generating a vibration and having no open holes formed therein which would allow air to pass through;

a magnet magnetic circuit including a magnet, said magnetic circuit being fixed to said vibration region via a pole piece so as to vibrate along with said vibration region;

a voice coil provided so as to interlink a magnetic field formed by said magnet; and a frame fixing said voice coil to said housing at a region other than said vibration region.

8. An information processing device according to claim 7, wherein said vibration region of said housing has a thickness smaller than that of a region of said housing other than said vibration region.

9. An information processing device according to claim 1 wherein said housing comprises a first housing having a keyboard unit and a second housing having a display unit, said second housing being openable and closable with respect to said first housing;

said vibration region being defined in the vicinity of said display unit of said second housing.

10. An information processing device according to claim 7, wherein said housing is formed of resin.

11. An information processing device according to claim 7, further comprising a damper for displaceably supporting said magnet to said frame.

12. A speaker unit for an information processing device comprising:

a magnetic circuit including a magnet, said magnetic circuit being adapted to be fixed to a vibration region of a housing of said information processing device via a pole piece so as to vibrate along with said vibration region, said vibration region being integrally included in said housing and made of the same material as the rest of the housing and being thin enough for generating a vibration and having no open holes formed therein which would allow air to pass through;

a voice coil provided so as to interlink a magnetic field formed by said magnet;

a frame fixing said voice coil to said housing at a region other than said vibration region; and a damper displaceably supporting said magnet to said frame.

* * * * *